US007210461B2

(12) United States Patent
Schreeck et al.

(10) Patent No.: US 7,210,461 B2
(45) Date of Patent: May 1, 2007

(54) INTERNAL COMBUSTION ENGINE FOR A MOTOR VEHICLE

(75) Inventors: Nico Schreeck, Wasuüttel (DE); Andreas Deyda, Wolfsburg (DE); Kurt Hoppe, Bad Sachsa (DE)

(73) Assignee: Volkswagen AG, Wolfsburg (DE)

( * ) Notice: Subject to any disclaimer, the term of this patent is extended or adjusted under 35 U.S.C. 154(b) by 0 days.

(21) Appl. No.: 11/314,461

(22) Filed: Dec. 21, 2005

(65) Prior Publication Data

US 2006/0162699 A1 Jul. 27, 2006

(30) Foreign Application Priority Data

Dec. 21, 2004 (DE) ..... 10 2004 061 505

(51) Int. Cl.
*F02M 55/02* (2006.01)

(52) U.S. Cl. ..... 123/468; 123/198 D

(58) Field of Classification Search ..... 123/468, 123/198 D, 184.38, 184.42, 184.47, 184.61
See application file for complete search history.

(56) References Cited

U.S. PATENT DOCUMENTS 5,050,701 A * 9/1991 Okui et al. ..... 180/297
5,630,387 A * 5/1997 Kamiyama ..... 123/184.38
5,950,586 A * 9/1999 Ropertz ..... 123/184.42
6,024,066 A * 2/2000 Nakayama et al. .... 123/184.21
6,161,513 A * 12/2000 Lohr et al. ..... 123/184.34
6,176,213 B1 * 1/2001 Arnegger ..... 123/184.61
6,283,078 B1 * 9/2001 Munetoki et al. ..... 123/184.61
6,371,070 B2 * 4/2002 Munetoki et al. ..... 123/184.61
6,539,907 B2 * 4/2003 Ino et al. ..... 123/184.55
6,752,114 B2 * 6/2004 Ochiai et al. ..... 123/184.21
6,776,132 B2 * 8/2004 Kudo et al. ..... 123/184.42

* cited by examiner

*Primary Examiner*—Mahmoud Gimie
(74) *Attorney, Agent, or Firm*—Klaus P. Stoffel; Wolff & Samson PC

(57) ABSTRACT

An internal combustion engine for a motor vehicle with a cylinder head, an intake manifold, and a fuel distributor rail. The downstream end of the intake manifold is connected by a flange to intake channels in the cylinder head of the internal combustion engine. The fuel distributor rail is located at the downstream end of the intake manifold and is connected to fuel injection valves. The internal combustion engine is installed in the motor vehicle in such a way that the intake manifold is located on the side of the cylinder head on which the external crash force will act during a crash. A protective strap, which extends at least over the entire width of the flange, is attached to the cylinder head. The protective strap is located so that, based on direction of the crash force, it is a certain distance in front of the fuel distributor rail and, based on the direction in which the intake manifold will be deformed upstream of the flange during a crash, this direction being at an angle to the direction of the crash force, a certain distance behind the intake manifold.

7 Claims, 2 Drawing Sheets

INTERNAL COMBUSTION ENGINE FOR A MOTOR VEHICLE

BACKGROUND OF THE INVENTION

The invention pertains to an internal combustion engine for a motor vehicle with a cylinder head, an intake manifold, and a fuel distributor rail, where the downstream end of the intake manifold is connected by a flange to the intake channels in the cylinder head of the internal combustion engine, where the fuel distributor rail is located at the downstream end of the intake manifold and is connected to fuel injection valves, and where the internal combustion engine is installed in the motor vehicle in such a way that the intake manifold is located on the side of the cylinder head on which the external crash force will act during a crash.

EP 0732 495 B1 describes an intake manifold for an internal combustion engine of a motor vehicle which has at least one intake manifold channel, where at least one of the intake manifold channels has a predetermined break zone, which is essentially parallel to the longitudinal direction of the channel. This gives the intake manifold better behavior in a crash. When a crash occurs, the intake manifold breaks along the predetermined break zone on the longitudinal axis and thus absorbs some of the energy of the crash.

A protective device for a fuel rail is known from U.S. Pat. No. 6,77,132 B2. This device is located underneath the intake manifold and is attached to the fuel rail. When a crash occurs, the protective device wraps itself plastically around the fuel rail and thus protects the fuel line from damage which might otherwise have been caused by the deformation of the intake manifold. The intake manifold absorbs some of the impact energy, and the fuel line remains undamaged. Thus, no fuel is able to leak out.

SUMMARY OF THE INVENTION

The invention is based on the task of improving an internal combustion engine of the type indicated above with respect to the safety offered in a crash.

This task is accomplished according to the invention by an internal combustion engine of the type indicated above, wherein a protective strap which extends at least over the entire width of the flange is attached to the cylinder head. The protective strap is located in such a way that, based on the direction of the crash force, it is a certain distance in front of the fuel distributor rail and, based on the direction in which the intake manifold will deformed upstream of the flange during a crash, this direction being at an angle to the direction of the crash force, a certain distance behind the intake manifold.

This offers the advantage that, because of the protective strap is supported on the cylinder head, it will, in the event of a crash, introduce forces into the deforming intake manifold upstream of the flange, as a result of which the point at which the intake manifold will break is shifted forward and the flange itself is relieved of load. Any fragments into which the deforming intake manifold may break will be produced far away from the fuel distributor rail and will be unable to approach to bar too closely. This effectively reduces the danger of damage to the fuel distributor rail which might otherwise be caused by fragments of the intake manifold. The intake manifold is thus effectively prevented from becoming deformed in the area between the protective strap and the flange, that is, in the area where the fuel distributor rail is located, and the flange is prevented from fracturing—either of which events could lead to damage to the fuel distributor rail.

It is advisable for the intake manifold to be designed as a one-piece intake manifold.

In another embodiment, the intake manifold has a section with intake channels, on at least one of which a predetermined breaking point is provided. The channel will break at this point during a crash, so that the intake can effectively absorb some of the crash energy.

The predetermined break point is preferably designed as a break line formed by a reduction in the thickness of the channel wall. The break line can be perpendicular, for example, to the longitudinal direction of the intake channel.

Another way of isolating the fuel distributor rail from the effects of the deformation of the intake manifold channels during a crash is to attach the fuel distributor rail not to the intake manifold itself but rather to the means by which the protective strap is fastened to the cylinder head.

The protective strap is preferably so stiff that it can resist the attempts of the crash force to deform it. As a result, a gap is maintained between the protective strap and the fuel distributor rail, and thus the protective strap also provides mechanical protection in the event of a crash.

The invention is explained in greater detail below on the basis of the drawing.

DETAILED DESCRIPTION OF THE INVENTION

Figure 1:
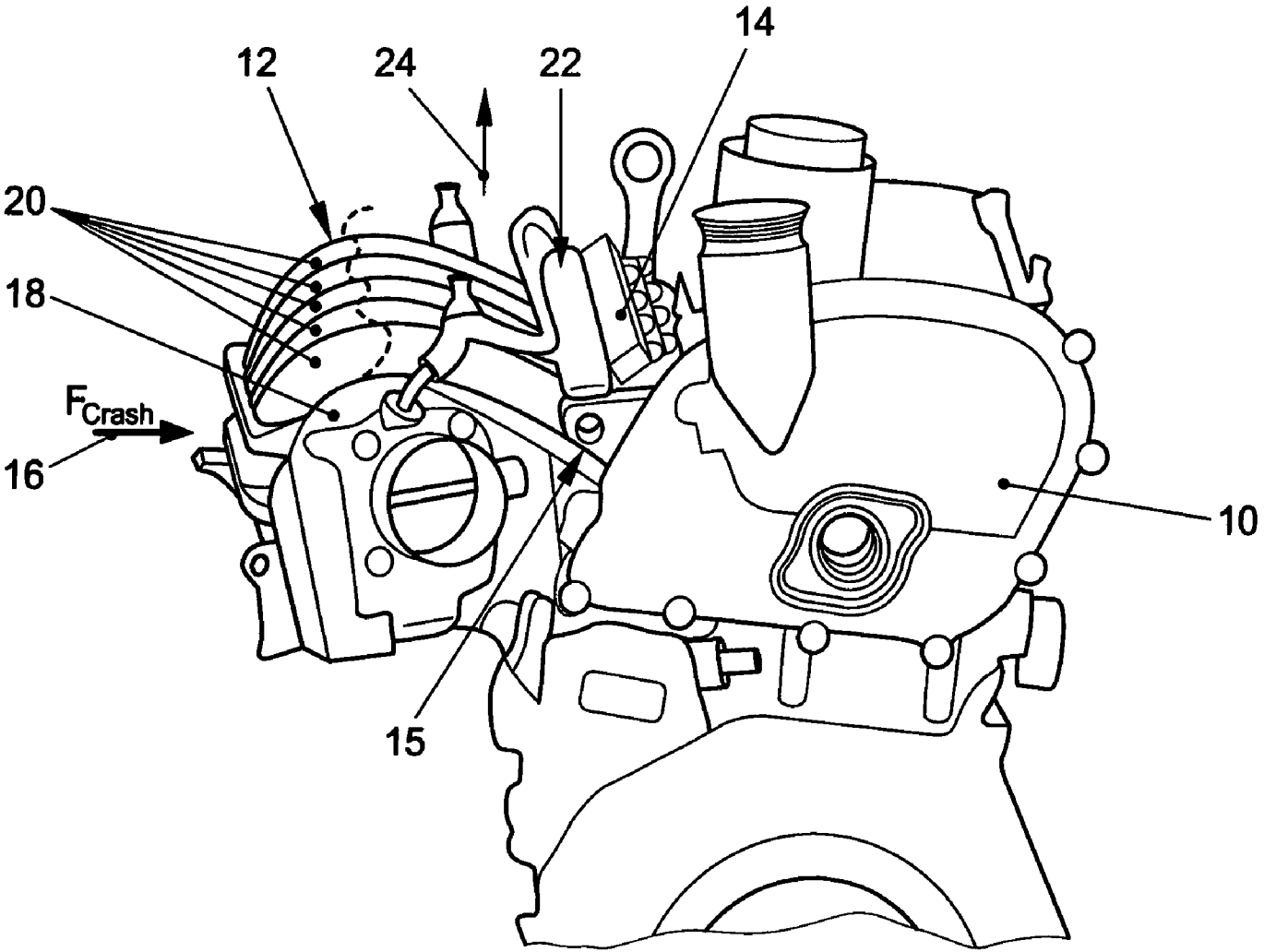
FIG. 1 shows a perspective view of a preferred embodiment of an inventive internal combustion engine pursuant to the present invention.
Figure 2:
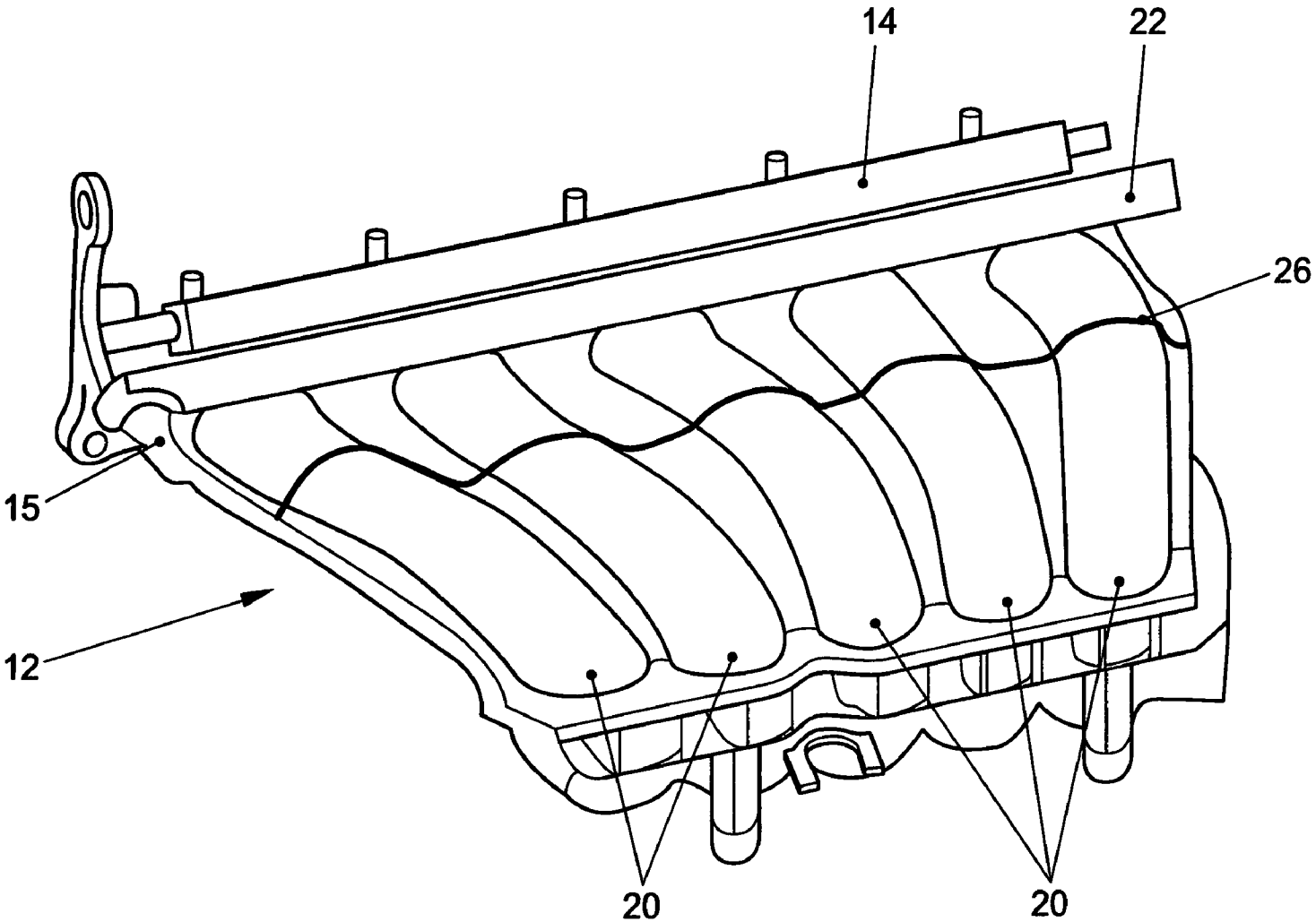
FIG. 2 shows a detailed view, in perspective, of the intake manifold, the fuel distributor rail, and the protective strap of the inventive internal combustion engine according to FIG. 1.

The embodiment of an inventive internal combustion engine illustrated in FIGS. 1 and 2 for a motor vehicle (not shown) comprises a cylinder head 10, an intake manifold 12, and a fuel distributor rail 14. The downstream end of the intake manifold 12 is connected by a flange 15 to the intake channels in the cylinder head 10. The fuel distributor rail 14 is located at the downstream end of the intake manifold 12 and is connected to fuel injection valves (not shown). The internal combustion engine is installed in the motor vehicle in such a way that the intake manifold 12 is located on the side of the cylinder head 10 on which an external crash force 16 will act during a crash. The intake manifold 12 comprises an intake plenum 18 and intake channels 20, which divide the air stream into individual substreams, one of which is sent to each cylinder of the internal combustion engine.

The expression "during a crash" used here describes a state in which a motor vehicle equipped with the inventive internal combustion engine strikes an obstacle, whereupon at least some of the kinetic energy of the vehicle is absorbed by deformation. In general, this involves the collision of the front end of the motor vehicle, i.e., the end facing in the direction of travel, with an obstacle, so that the front area of the vehicle is deformed and kinetic energy is absorbed there (front-end collision). When the vehicle strikes an obstacle in this way, the crash force therefore acts in the direction opposite that of vehicle travel. Parts of the chassis of the vehicle and components of the internal combustion engine in the engine compartment such as the intake manifold will be deformed. Use is made of the intake manifold in particular as an effective way of absorbing some of the crash energy through the deformation of the intake channels 20.

According to the invention, a protective strap 22 is attached to the cylinder head 10. This strap 22 extends at least over the entire width of the flange 15 and is arranged in such a way that the protective strap 22, based on the direction of the crash force 16, is a certain distance in front of the fuel distributor rail 14 and, based on the direction 24 in which the intake manifold 12 will be deformed upstream of the flange 15 during a crash, this direction being at an angle to the direction of the crash force 16, that is, not parallel to it, a certain distance behind the intake manifold 12.

As a result, a protected area of the intake manifold 12 is created between the protective strap 22 and the flange 15, an area which cannot be deformed during a crash. If, during a crash, the intake channels 20 are pushed upward, that is, in the direction of the arrow 24 (FIG. 1), the protective strap 22 prevents such movement in the protected area and instead transmits the forces to the intake manifold 12 at a point farther away from the flange 15 and from the fuel distributor rail 14. If the intake manifold 12 breaks as a result of the crash, this break will therefore occur a certain distance away from the fuel distributor rail 14. Any fragments of the intake manifold 12 which may break off will be produced relatively far away from the fuel distributor rail 14 and thus will be unable to damage it. The protective strap 22 also prevents breakage of the intake channels in the area of the flange 15, so that no damage to the fuel distributor rail 14 can occur as a result of this either. Thus the protective strap 22 both provides mechanical protection for the fuel distributor rail 14 and prevents the deformation of the intake manifold 12 in the area of the fuel distributor rail 14.

In the event of a crash, however, the protective strap 22 remains firmly in place because of its rigid connection to the cylinder head 10 and thus defines a deformation-free zone between itself and the flange 15. This is the zone in which the fuel distributor rail 14 is located. The protective strap 22 thus causes the intake manifold 12 to be destroyed intentionally in noncritical areas by transmitting stresses into a forward area of the one-piece intake manifold 12 during a crash. As a result, a low-cost, one-piece intake manifold design can be retained, which is nevertheless still able to provide increased safety against damage to the fuel distributor 14 in the event of a crash.

For the effective absorption of crash energy, the intake channels 20 are also provided with a break line 26 (FIG. 2), essentially perpendicular to the longitudinal direction of the intake channels 20. This break line 26 represented the predetermined place where the channels 20 will break during a crash and is produced, for example, by reducing the wall thickness of the intake channels 20 along the break line.

The inventive arrangement and design of the protective strap 22 guarantees that, in the event of a crash, no fuel will be able to leak our and that none of the components deformed by the crash force 16 will be able to contact the fuel distributor rail 14. The seat of the injection valves located underneath the fuel distributor rail 14 will not be destroyed either, because a deformation-free zone is created between the protective strap 22 and the flange 15.

The protective strap 22 takes over the function of introducing stresses to a forward area of the intake manifold 12 and thus relieves the flange 15 of load. The flange 15 is therefore effectively prevented from being broken even in extreme situations. In the event of a crash, the protective strap 22 prevents the intake channels 20 from being deflected upward in the direction of arrow 24 and transmits the additional stresses into the forward area of the intake manifold 12. During a crash, the intake manifold 12 will therefore fail at the appropriately intended predetermined break points, which in any case are far enough away from the fuel distributor rail 14 that fragments of the intake manifold 12 cannot cause any damage to the fuel distributor rail 14. The protective strap 22 thus also protects the fuel distributor rail 14.

As a result, the "up-front" arrangement of the intake manifold in the crash area can be retained. Such an arrangement is necessary for engine designs in which the air filter is permanently connect to the engine. The low-cost concept of a one-piece intake manifold 12 can also be retained. The protective strap 22 has the primary function of influencing the breakage behavior of the intake manifold 12 during a crash and the secondary function of protecting the fuel distributor rail 14 from broken pieces.

Because the protective strap 22 is supported laterally against the flange 15, the breaking stress is introduced into noncritical areas, and in the event of a crash the intake manifold 12 will break before the fuel distributor 14 can be damaged.

Thus, while there have been shown and described and pointed out fundamental novel features of the present invention as applied to a preferred embodiment thereof, it will be understood that various omissions and substitutions and changes in the form and details of the devices illustrated, and in their operation, may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

The invention claimed is:

1. An internal combustion engine for a motor vehicle, comprising a cylinder head; and intake manifold; a fuel distributor rail, a downstream end of the intake manifold being connected by a flange to intake channels in the cylinder head, the fuel distributor rail being located at the downstream end of the intake manifold and connected to the fuel injection valves, and the internal combustion engine being installed in the motor vehicle so that the intake manifold is located on a side of the cylinder head on which an external crash force will act during a crash; and a protective strap, which extends at least over an entire width of the flange, is attached to the cylinder head, the strap being located so that, based on a direction of the crash force, the protective strap is a certain distance in front of the fuel distributor rail and, based on a direction in which the intake manifold will be deformed upstream on the flange during a crash, the deformation direction being at an angle to the direction of the crash force, a certain distance behind the intake manifold.

2. The internal combustion engine according to claim 1, wherein the intake manifold is a one-piece intake manifold.

3. The internal combustion engine according to claim 1, wherein the intake manifold has a section with intake channels, a predetermined break point being provided on at least one of the intake channels at which break point the intake channel will break during a crash.

4. The internal combustion engine according to claim 3, wherein the predetermined break point is a break line formed by a reduction in thickness of a wall of the channel.

5. Internal combustion engine according to claim 4, wherein the break line is perpendicular to a longitudinal direction of the intake channel.

6. The internal combustion engine according to claim 1, wherein the fuel distributor rail is attached to means by which the protective strap is fastened to the cylinder head.

7. The internal combustion engine according to claim 1, wherein the protective strap is sufficiently rigid to resist deformation by the crash force.

* * * * *